US008783637B2

(12) United States Patent
Isenberg et al.

(10) Patent No.: US 8,783,637 B2
(45) Date of Patent: Jul. 22, 2014

(54) TEMPORARY SHAFT SUPPORT SYSTEM

(75) Inventors: Timothy J. Isenberg, Marshfield, WI (US); John E. Zirbel, Marshfield, WI (US)

(73) Assignee: Cheese & Whey Systems, Inc., Marshfield, WI (US)

( * ) Notice: Subject to any disclaimer, the term of this patent is extended or adjusted under 35 U.S.C. 154(b) by 70 days.

(21) Appl. No.: 13/089,044

(22) Filed: Apr. 18, 2011

(65) Prior Publication Data

US 2011/0253864 A1 Oct. 20, 2011

Related U.S. Application Data

(60) Provisional application No. 61/325,612, filed on Apr. 19, 2010.

(51) Int. Cl.
*A47H 1/10* (2006.01)

(52) U.S. Cl.
USPC ..... 248/322; 248/59; 248/73; 134/167 R; 134/166 R

(58) Field of Classification Search
USPC ..... 248/251, 327, 339, 322, 694, 58, 59, 248/62, 63, 73, 74.1, 690; 134/167 R, 166 R
See application file for complete search history.

(56) References Cited

U.S. PATENT DOCUMENTS

| | | | | | |
|---|---|---|---|---|---|
| 3,001,534 | A | * | 9/1961 | Grant, Jr. | 134/167 R |
| 3,480,246 | A | * | 11/1969 | Pfeiffer et al. | 248/327 |
| 4,989,504 | A | | 2/1991 | Jay | |
| 5,513,559 | A | | 5/1996 | Jay | |
| 5,606,907 | A | | 3/1997 | Jay | |
| 5,718,765 | A | * | 2/1998 | Unger et al. | 118/405 |
| 5,985,347 | A | | 11/1999 | Ejnik | |
| 7,300,000 | B2 | * | 11/2007 | Kitamura et al. | 239/263.1 |
| 7,387,431 | B2 | | 6/2008 | Blakley | |
| 2008/0131313 | A1 | * | 6/2008 | Bokelmann et al. | 422/28 |

FOREIGN PATENT DOCUMENTS

| | | | |
|---|---|---|---|
| DE | 9215267 U1 | | 2/1993 |
| WO | WO9830319 | * | 7/1998 |

* cited by examiner

*Primary Examiner* — Nkeisha Smith
(74) *Attorney, Agent, or Firm* — Boyle Fredrickson, S.C.

(57) ABSTRACT

A temporary shaft support system is provided that can be used with an enclosure such as food processing equipment. The system may include a holder for engaging a shaft to be supported, and a lift that is supported from the food processing equipment at a position that is higher than the shaft to allow the shaft to be suspended and supported without occupying floor space of the food processing equipment. The lift may be supported by a top wall of the food processing equipment or may be supported by a drive mount that attaches a shaft-rotating drive to the food processing equipment.

12 Claims, 6 Drawing Sheets

TEMPORARY SHAFT SUPPORT SYSTEM

CROSS-REFERENCE TO RELATED APPLICATIONS

This application claims priority from U.S. Provisional Patent Application Ser. No. 61/325,612 filed on Apr. 19, 2010, the entirety of which is expressly incorporated by reference herein.

BACKGROUND OF THE INVENTION

1. Field of the Invention

The invention relates to food processing equipment and, more particularly, to mechanisms that support shafts of food processing equipment to allow for service of cooperating components.

2. Discussion of the Related Art

Food processing equipment having rotating assemblies with shafts that include cooperating support bearings, bushings, and/or seals are known. The bearings, bushings, and/or seals are typically not readily serviceable. Some prior art food processing equipment require cutting the shaft away from its supporting wall in the equipment in order to service or replace the bearings, bushings, and/or seals. In such prior art food processing equipment, shaft supports are built inside of the vat and are positioned on the vat bottom wall, temporarily supporting the shaft from below.

SUMMARY OF THE INVENTION

The inventors have recognized that rotating assemblies of food processing equipment are serviced less frequently than is desirable because servicing or replacing bearings, bushings, and/or seals can be a substantial undertaking in terms of both time and money. The inventors have also recognized that prior art temporary shaft supports that are built inside of the equipment can scratch or otherwise damage inner surfaces of walls of the equipment, which may be highly polished. The inventors have also recognized that prior art temporary shaft supports that are built inside of the equipment and support shafts from below can have large footprints that occupy large areas on the bottom walls of the equipment and a significant amount of space within the equipment, which can present maneuvering difficulties for technicians that are servicing the rotating assemblies. The present invention contemplates a temporary shaft support system that addresses these and other inventor-identified problems and drawbacks of the prior art.

In accordance with an aspect of the invention, a temporary shaft support system is provided that may be used with a food processing vat which includes one or more rotating assemblies, each of which includes a shaft. The shaft support system includes a holder for engaging and holding a shaft within a vat. A shaft height is defined at a position that the shaft is provided with respect to the vat. A lift is connected to the holder and can actuate to move the holder in a generally vertical direction for temporarily supporting the shaft so as to unload the shaft from its supporting components within the vat. The lift is supported by the vat and may be provided at a height with respect to the vat that defines a lift height. The lift height may be higher than the shaft height. This may allow the shaft support system to suspend the shaft instead of supporting it from below, which may provide a substantial amount of room in the vat in which technicians can work, including open floor space below the shaft.

In accordance with another aspect of the invention, the lift is supported by and provided outside of the vat. The lift may engage and be supported by a top wall of the vat. Alternatively, the lift may engage and be supported by a drive mount that attaches a drive to the vat. The holder may engage and hold a portion of the shaft that is inside of the vat, or the holder may engage and hold a portion of the shaft that is outside of the vat. The holder may be in the form of a hook that engages an outer surface of the shaft. This may allow the shaft support system to temporarily hold the shaft without occupying floor space below the shaft and which may provide a substantial amount of room in the vat in which technicians can work.

In accordance with another aspect of the invention, the lift includes a rod that is connected to the holder and may further include a threaded actuator that translates movement to the holder. The threaded actuator may include a threaded segment of the rod and may also include a handle that can rotate and that engages the threaded segment of the rod so that rotation of the handle forces the rod and holder to travel upwardly or downwardly. The upward or downward movement of the rod and holder may be achieved by forcing the rod to longitudinally advance or regress with respect to the handle. The handle may include a central hub that has a threaded bore that accepts the threaded segment of the rod therethrough which may allow the rod to advance or regress through the handle. This may allow the shaft support system to temporarily hold the shaft from above, without occupying floor space below the shaft and which may provide a substantial amount of room in the vat in which technicians can work.

In accordance with another aspect of the invention, a slip surface may be provided between the handle and a base that engages a supporting surface of the vat. The slip surface may be provided between a bottom surface of a handle central hub and the base. The slip surface may have a lower coefficient of friction than the bottom surface of the central hub of the handle and/or other portions of the base. The slip surface may be defined at an upper surface of a material that differs from that of at least one of the central hub of the handle and the base. The slip surface may be defined at an upper surface of a polymeric disc that is provided on the base or at an upper surface of a polymeric bushing that is seated in the base. The slip surface may accommodate rotation of the handle with respect to the base of the lift for unloading the shaft from its supporting bearing, bushing, or seal. This may allow the shaft support system to temporarily hold the shaft without occupying floor space below the shaft and which may provide a substantial amount of room in the vat in which technicians can work.

Various other features, objects, and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
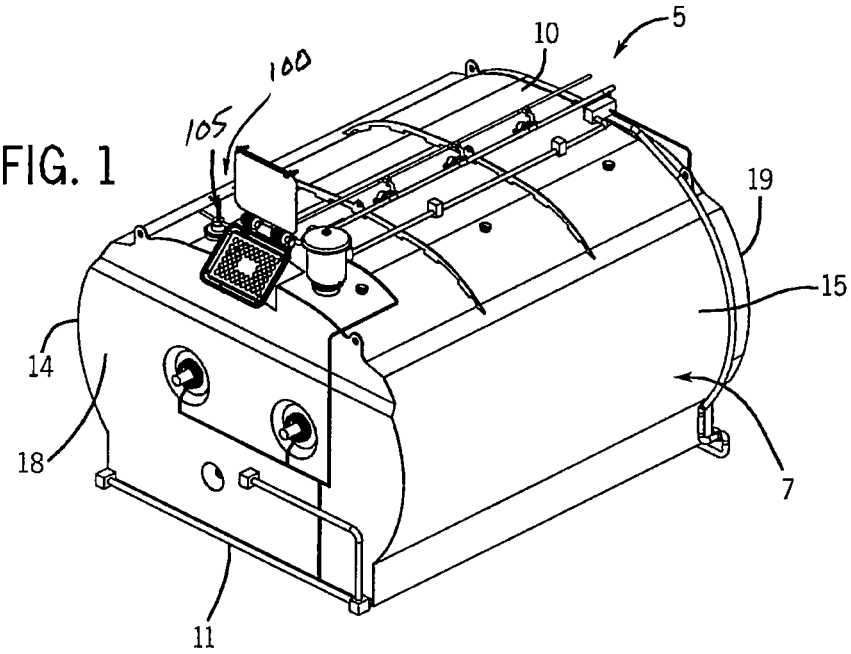
FIG. 1 is an isometric view from above and in front of a vat system in connection with which a temporary shaft support system in accordance with the present invention may be employed.
Figure 2:
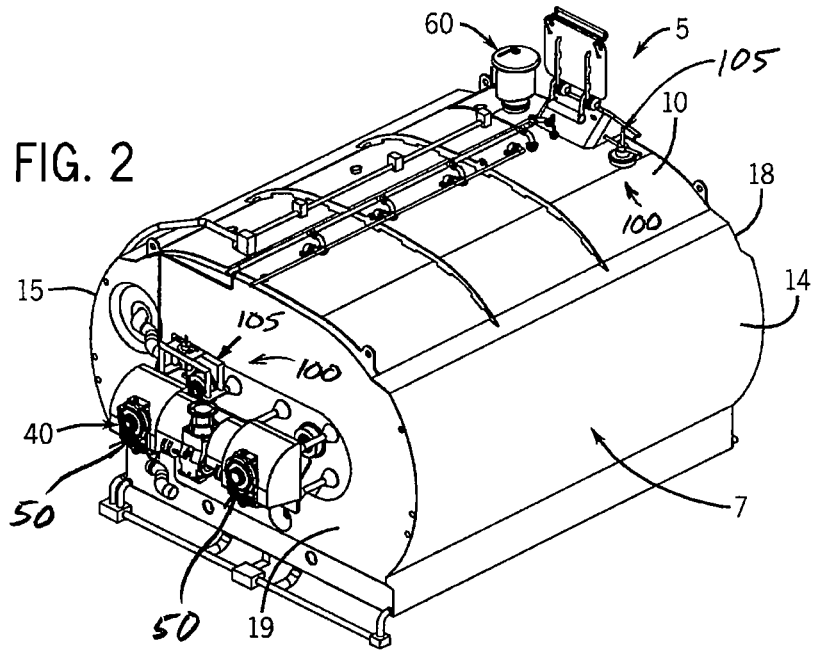
FIG. 2 is an isometric view from above and in back of the vat system of FIG. 1.

FIGS. 1 and 2 illustrate a vat system 5 in connection with which a temporary shaft support system 100 in accordance with the present invention may be employed. Vat system 5 can be used for processing food and related products. The temporary shaft support system 100 is described as being used in the vat system 5 to simplify its explanation, with the understanding that the temporary shaft support system 100 in other embodiments may be implemented in various other enclosures, such as enclosed food processing machines and/or other suitable enclosed machines that require technicians to service shaft supporting bearings, bushing, seals, or other components of rotating assemblies.

Still referring to FIGS. 1 and 2, vat system 5 can be used for processing the food and related products (collectively referred to as "vat contents") by mechanically manipulating and heating or cooling the vat contents, depending on the particular food or related product being processed. In a representative application, the vat system 5 may be used in the production of cheese, although it is understood that the vat system 5 may be used in processing other types of food products. The system 5 includes a vat 7 that has an agitation system 40 which performs the mechanical manipulations tasks by using a motor that delivers power to a pair of drives 50 (FIG. 2) to rotate a pair of shafts 45 upon which blade assemblies are mounted, and a zoned heat transfer system to perform such heating and/or cooling to provide zoned temperature control to the vat 7.

Vat 7 defines an enclosure having a top wall 10, a bottom wall 11, and side walls 14, 15, all of which extend longitudinally between a pair of end walls 18 and 19. The walls 10, 11, 14, 15, 18, 19 are multilayered, having an outer jacket 20 and an inner shell 25 that are spaced from each other. Insulation and various components of the zoned heat transfer system are housed between the jacket 20 and shell 25. The shell 25 is the inmost structure of the vat 7 so that its inner surface surrounds and defines an outer periphery of a void or inside space 8 within the vat 7. A lower part of the inside space 8 resembles two horizontal parallel cylinders that transversely intersect each other being defined by a lower portion of the shell 25 that has a pair of arcuate depressions which extend along the length of the vat 7 on opposing sides of a longitudinally extending raised middle segment. From the lower portion of the shell 25, opposing side portions extend in an outwardly bowed manner, arching away from each other in a transverse direction of the vat 7. An upper portion of the shell 25 arcs gradually between side portions of the shell 25 and defines an upper perimeter of the inside space 8 of vat 7.

Figure 3:
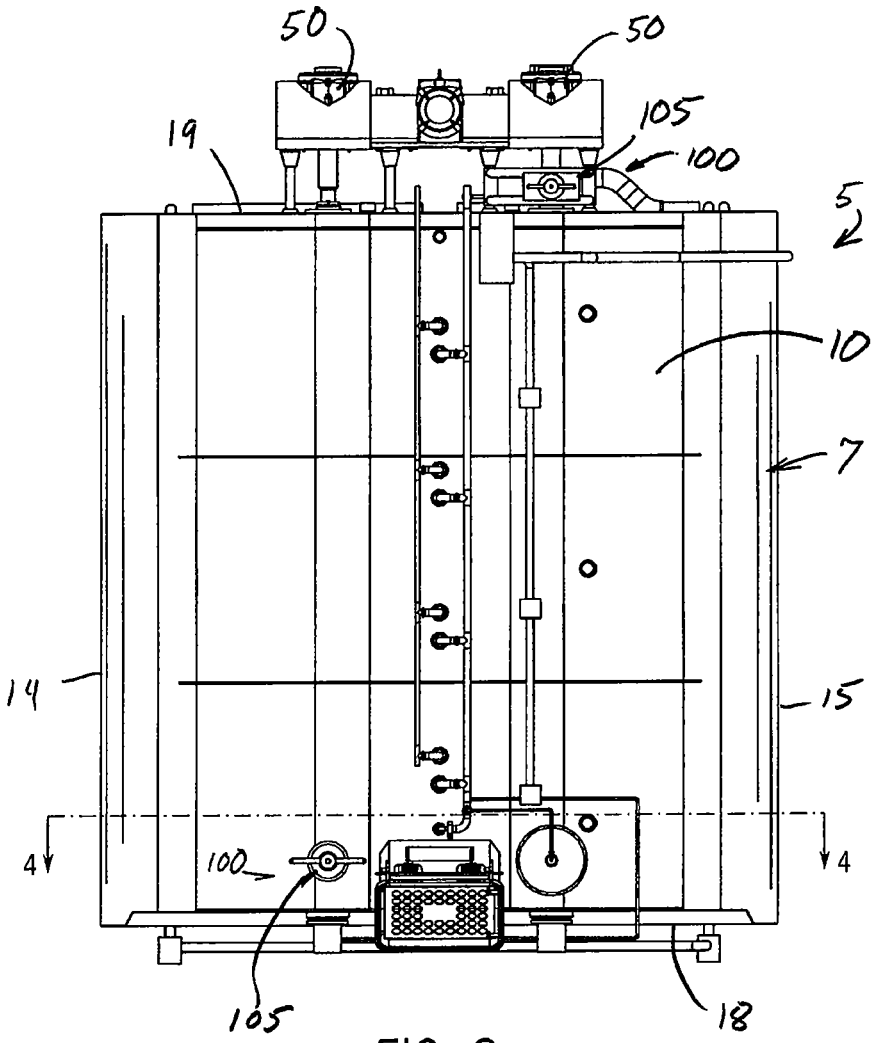
FIG. 3 is a top plan view of the vat system of FIG. 1.

Referring now to FIGS. 2 and 3, temporary shaft support system 100 includes two shaft supports 105. One shaft support 105 is adjacent the front wall 18 and is supported by the top wall 10. The other shaft support 105 is adjacent the back wall 19 and is supported by a drive mount 52 that attaches the drive 50 to the vat 7. Each of the shaft supports 105 includes a holder 110 and a lift 150 that cooperate to suspend the shaft(s) 45 from above instead of supporting it from below by floor or bottom wall-engaging structures. Correspondingly, each of the shaft supports 105 defines a lift height with respect to the vat 7 that is higher than a shaft height at which the shaft(s) 45 is positioned in the vat 7. This allows the temporary shaft support system 100 to hold the shaft 45 in a manner that provides a substantial amount of room in the vat 7 in which technicians can work, including open floor space below the shaft(s) 45 while servicing the shaft(s) 45 or cooperating components.

Figure 4:
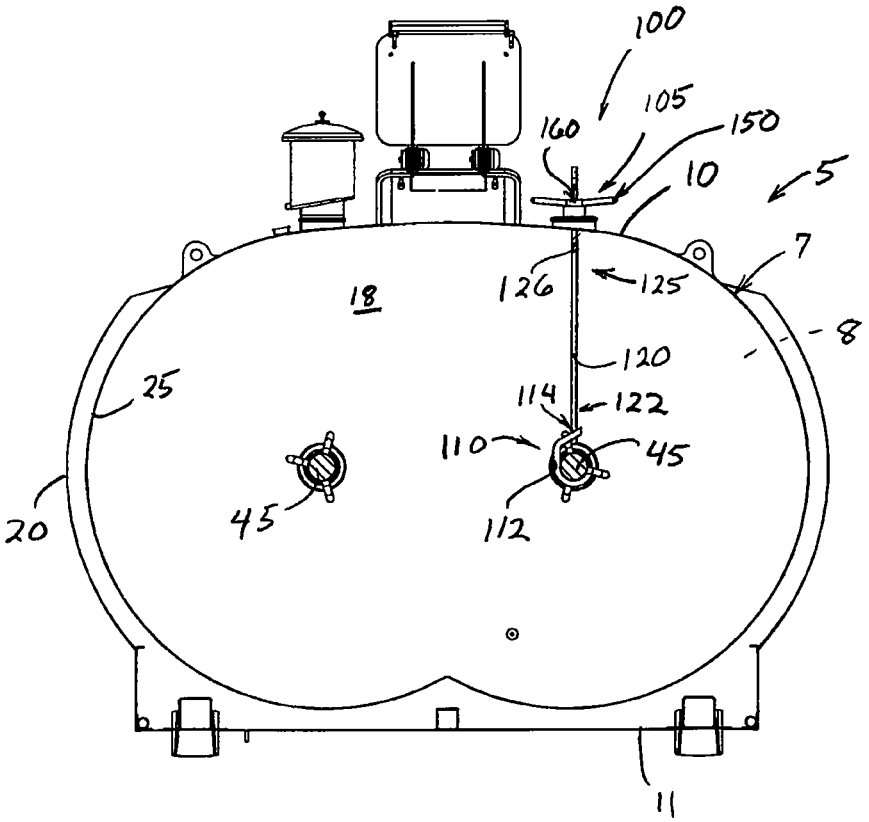
FIG. 4 is a sectional view of the vat system of FIG. 3, taken at line 4-4 of FIG. 3.
Figure 7:
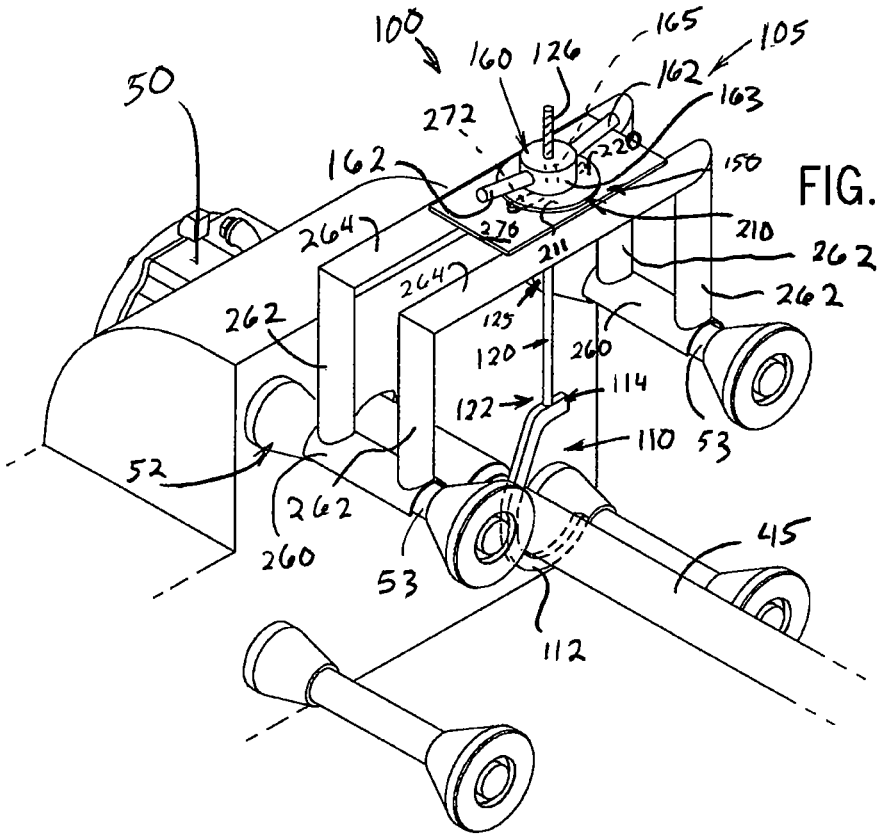
FIG. 7 is an isometric view of a second shaft support used in connection with the vat system of FIG. 1.

Referring now to FIGS. 4 and 7, the holder 110 in each of the shaft supports 105 of these embodiments is defined by a hook 112 that can engage a lower surface 47 of the shaft 45 in a cupping or cradle-like manner. A lower end 122 of a rod 120 connects to an upper end 114 of the hook 112 and extends upwardly away from the hook 112. The rod 120 has an upper end 125 with a threaded segment 126 that, in this embodiment, has external threads. The threaded segment 126 of the rod 120 engages the lift 150 for moving the rod 120 and hook 112 upwardly or downwardly, explained in greater detail elsewhere herein.

Figure 5:
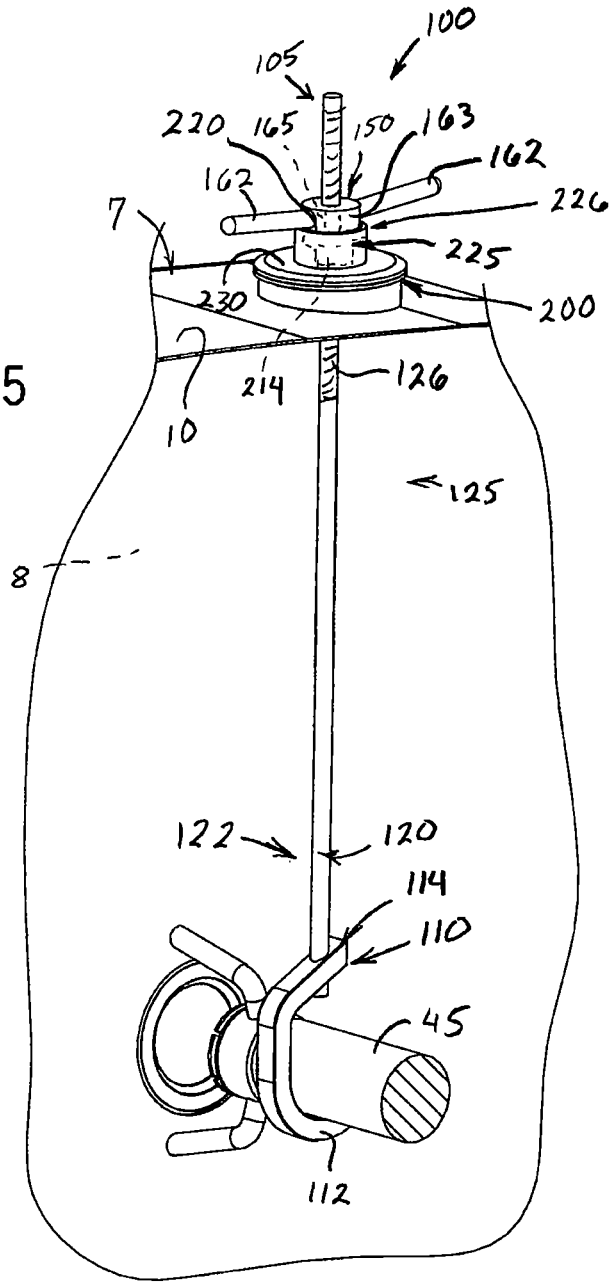
FIG. 5 is an isometric view of a first shaft support used in connection with the vat system of FIG. 1.
Figure 6:
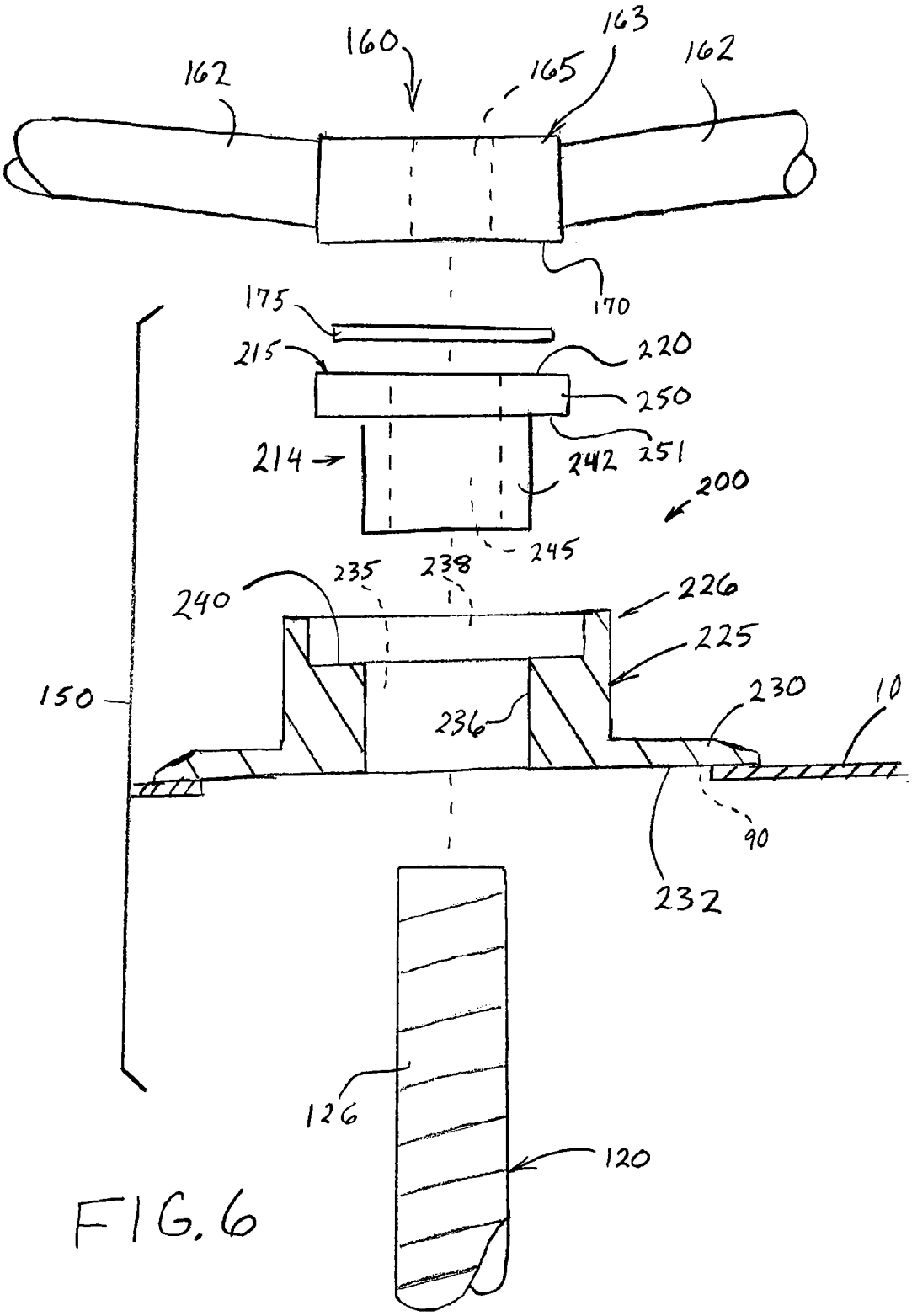
FIG. 6 is an exploded partially sectional view of portions of the shaft support of FIG. 5.
Figure 8:
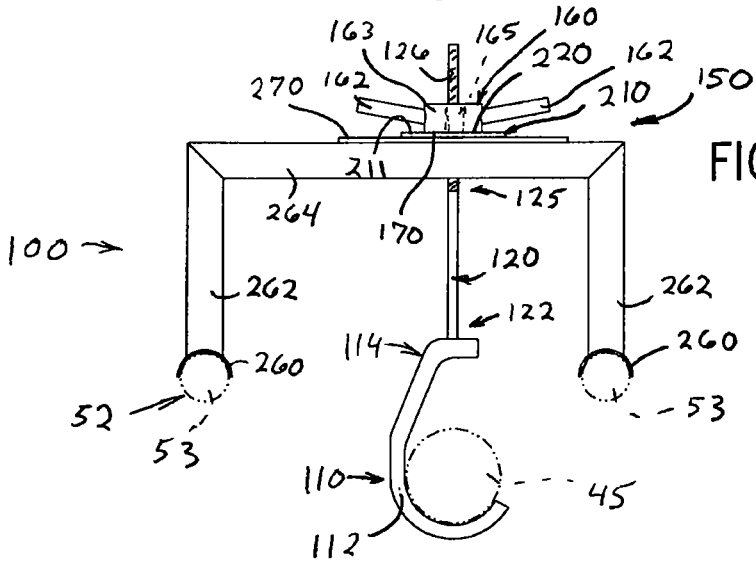
FIG. 8 is a side elevation of the shaft support of FIG. 7.

Referring now to FIGS. 5-7, lift 150 includes a base 200 that engages the vat 7 and a handle 160 that cooperates with the threaded segment 126 of the rod 120 to serve as a threaded actuator. Handle 160 includes a pair of grips 162 extending in opposing directions from a central hub 163. An internally threaded bore 165 extends longitudinally through the central hub 163 of the handle 160. The internally threaded bore 165 cooperates with the threaded segment 126 of the rod 120 so that rotation of the handle 160 is translated into linear movement of the rod 120 and hook 110 in a substantially vertical direction. As shown in FIGS. 6 and 8, a bottom surface 170 of the handle central hub 163 engages and rotates upon the base 200.

Referring still to FIGS. 5-7, base 200 includes a plate 210 (FIG. 8) or a bushing 214 (FIGS. 5 and 6) that is made from a material that is different from that of the handle 160. The material of plate 210 and bushing 214 has a lower coefficient of friction than that of the handle 160, such that a slip surface 220 is defined by the upper surfaces 211, 215 of the plate 210 and bushing 214. The bottom surface 170 (FIGS. 6 and 8) of the handle central hub 163 can easily slide across and rotate upon the slip surface 220. The slip surface 220 has slip characteristics that are sufficient to prevent static friction between the handle 160 and base 200 that would otherwise prevent initial rotation of the handle 160 when the hook 110 is supporting the weight of the shaft 45, ensuring that a technician can rotate the handle 160 at all times during use of the system 100. In one embodiment, the slip surface 220 is defined upon a plate 210 (FIG. 8) that may be made from a low friction material such as TEFLON. In another embodiment, the slip surface 220 is defined upon a bushing 214 (FIG. 5) that may be made from a low friction material such as DERLIN. It is understood that the plate 210 and bushing 214 can be made from other polymeric or metallic materials to provide the slip surface 220, so long as the amount of friction between the handle 160 and slip surface 220 is low enough to allow a technician to manually rotate the handle 160. It is further understood that the slip surface 220 may be provided on the handle instead of the base 200.

Referring now to FIG. 6, the base 200 of this embodiment includes a body 225 from which a bottom flange 230 radially extends. Flange 230 has a lower surface 232 that engages the top wall 10 of the vat. A bore 235 extends longitudinally through the body 225 and aligns with a port 90 that extends through the top wall 10 of the vat 7. When the port 90 is not being used allowing the shaft support 105 to access the shaft 45, it may be covered or have a vent or other vat accessory or component mounted to it. A counter bore 238 extends into an upper end 226 of the base body 225. A shoulder 240 is defined by an upwardly facing surface of the inner circumferential sidewall 236 at the intersection of the bore 235 and counter bore 238.

Still referring to FIG. 6, bushing 214 includes a neck 242 that extends downwardly from a flange 250. The neck 242 is housed concentrically in the bore 235 of the base body 225, and a lower surface 251 of the flange 250 abuts the shoulder 240 of the base body 225.

When the bushing 214 is seated in the base body 225 in this way, a bore 245 that extends through the flange 250 and neck 242 of the bushing is concentrically aligned within and extends entirely through the bore 235 of the base body 225. This positions the bushing 214 within the base body 225 so that the slip surface 220 faces toward the handle 160. In this embodiment, a washer 175 is provided between the slip surface 220 and bottom surface 170 of the handle central hub 163.

Referring now to FIGS. 7 and 8, the base 200 of this embodiment includes a pair of cups 260 that engage and are supported by a pair of tubes 53 of the drive mount 52. A pair of upright bars 262 extends upwardly from each of the cups 260. A pair of cross bars 264 extends between and connect the pairs of upright bars 262 to each other. In this regard, the cups 260 and upright and cross bars 262, 264 in combination define a framework that extends above and across the drive mount 52 while being supported by the drive mount 52. A shelf 270 spans between and is connected to the cross bars 264 and has a slot 272 through which the rod 120 extends. This allows the rod 120 to move along the length of the slot 272 which moves the rod 120 and hook 112 transversely with respect to the shaft 45, which allows the hook 112 to engage the shaft 45 so that the rod 120 is positioned substantially vertically. The shelf 270 supports the handle 160, with the plate 210 in between, so that the slip surface 220 defined by the plate upper surface 211 engages the bottom surface 170 of the handle central hub 163. Although the plate 210 of this embodiment is round, it is understood that the plate 210 can have any perimeter shape so long as the interface between the slip surface 220 and handle 160 provides a low enough friction value to allow a technician to manually rotate the handle 160.

Referring again to FIGS. 5 and 7, when using the shaft support 105, when the hook 112 engages the shaft 45, rotation of the handle 160 is translated into vertical movement of the hook 112, upwardly or downwardly depending on the direction of rotation of the handle 160. That is because the cradling-type engagement of the hook 112 upon the shaft 45 mechanically prevents the hook 112 and rod 120 from rotating about a longitudinal axis of the rod 120. Accordingly, when the handle 160 is rotated, threads of the internally threaded bore 165 of the handle 160 climb on the threads of the threaded segment 126 of the rod 120 and, since the rod 120 cannot rotate, the threaded segment 126 is drawn through the internally threaded bore 165 of the handle 160. This forces a linear advancement of the rod 120 upwardly through the handle 160 to lift the hook 112 and shaft 45, or a linear regress of the rod 120 downwardly through the handle 160 to lower the hook 112 and shaft 45, depending on the direction of rotation of the handle 160. In this way, the shaft(s) 45 can be supported by the temporary shaft support system 100 without occupying any floor space below the shafts 45 and thereby providing a substantial amount of room in the inside space 8 of the vat 7 in which technicians can work while servicing the shaft(s) 45 or cooperating components.

Various alternatives and embodiments are contemplated as being within the scope of the following claims particularly pointing out and distinctly claiming the subject matter regarded as the invention.

We claim:

1. A temporary shaft support system for use with an enclosure, comprising:

a holder for engaging and holding a shaft within the enclosure, wherein the enclosure defines a space within which material is contained and the shaft is arranged within the space for processing the material within the enclosure, wherein the shaft is provided at a height with respect to the enclosure that defines a shaft height; and a lift that is connected to the holder and can actuate to move the holder in a generally vertical direction for temporarily supporting the shaft, the lift being supported by the enclosure and provided at a height with respect to the enclosure that defines a lift height that is higher than the shaft height, the lift further comprising a rod that is connected to the holder and a threaded actuator that translates movement to the holder and wherein the lift is configured to be temporarily supported by the enclosure and arranged with respect to the shaft and the holder to support the shaft at the shaft height within the space of the enclosure;

wherein the threaded actuator includes a handle that can rotate and that engages a threaded segment of the rod so that rotation of the handle forces the rod and holder to travel upwardly or downwardly, the handle including a central hub having a threaded bore that accepts the threaded segment of the rod therethrough; and wherein the central hub of the handle includes a bottom surface and the lift includes a base that is engaged by the bottom surface of the handle, a slip surface being provided between the bottom surface of the central hub of the handle and the base for accommodating rotation of the handle with respect to the base of the lift.

2. The temporary shaft support system of claim 1, wherein rotation of the handle forces the rod to longitudinally advance or regress with respect to the handle.

3. The temporary shaft support system of claim 1, wherein the slip surface has a lower coefficient of friction than at least one of the bottom surface of (i) the central hub of the handle, and (ii) the base.

4. The temporary shaft support system of claim 3, the slip surface being defined at an upper surface of a material that differs from that of at least one of the central hub of the handle and the base.

5. The temporary shaft support system of claim 1, wherein the lift is provided outside of the enclosure so that an operator can rotate the handle from outside of the enclosure.

6. The temporary shaft support system of claim 1, wherein the base is supported by at least one of an upper wall of the enclosure and a drive mount that attaches a drive to the enclosure.

7. The temporary shaft support system of claim 1, wherein the holder is a hook that engages an outer surface of the shaft.

8. The temporary shaft support system of claim 1, wherein the lift is configured to be temporarily supported by and provided outside of the enclosure.

9. The temporary shaft support system of claim 8, wherein the lift is supported by a top wall of the enclosure.

10. A temporary shaft support system for use with an enclosure comprising:

a holder configured to engage and hold a shaft within the enclosure, the shaft being arranged for rotation at a fixed height with respect to the enclosure that defines a shaft height; and a lift that is supported by and provided outside of the enclosure, the lift being connected to the holder and configured to move the holder in a generally vertical direction for temporarily supporting the shaft, wherein the lift is supported by a drive mount that attaches a drive that rotates the shaft within the enclosure.

11. A temporary shaft support for use with an enclosure comprising:

a holder for engaging and holding a shaft within the enclosure, wherein the enclosure defines a space within which material is contained and the shaft is arranged within the space for processing material contained within the enclosure;

a lift that is configured to be temporarily supported by and provided outside of the enclosure, the lift being connected to the holder and arranged for moving the holder in a generally vertical direction for temporarily supporting the shaft at a shaft height within the space of the enclosure, the lift further comprising a threaded actuator that includes a handle that can be rotated to raise or lower the holder;

the lift including a base that supports the handle and wherein a slip surface is provided between the base and the handle and accommodates rotation of the handle with respect to the base.

12. The temporary shaft support system of claim 11, wherein at least a portion of the lift and at least a portion of the holder are arranged on opposing sides of a wall of the enclosure.

* * * * *